US006735831B1

(12) United States Patent
Greiwe et al.

(10) Patent No.: US 6,735,831 B1
(45) Date of Patent: May 18, 2004

(54) CREMATION REMAINS CONTAINER WITH MEMORIALIZATION FEATURES

(75) Inventors: John Greiwe, Batesville, IN (US); Rodger Jones, Indianapolis, IN (US); Chris Lowery, Batesville, IN (US); Daniel J. Parker, Connersville, IN (US); Mark Thesken, Cincinnati, OH (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 09/583,485

(22) Filed: May 31, 2000

(51) Int. Cl.[7] ..... A61G 17/00

(52) U.S. Cl. ..... 27/1; 40/724; 312/114

(58) Field of Search ..... 27/1; 206/6.1, 206/566; 40/722, 723, 724, 725, 375, 491, 124.5; 312/291, 292, 293.1, 293.2, 290, 902, 114, 126; 428/913.3

(56) References Cited

U.S. PATENT DOCUMENTS

| | | | | | |
|---|---|---|---|---|---|
| 422,084 | A | * | 2/1890 | Learman | 27/2 |
| 1,984,345 | A | * | 12/1934 | Kennedy | 312/293.1 |
| 2,023,260 | A | * | 12/1935 | Beers et al. | 312/114 |
| 3,554,625 | A | * | 1/1971 | Sly, Sr. | 312/234 |
| 4,199,848 | A | * | 4/1980 | Kohnert | 27/1 |
| 4,324,026 | A | | 4/1982 | Craft | |
| 4,773,530 | A | * | 9/1988 | Holtzman et al. | 206/232 |
| 4,811,996 | A | * | 3/1989 | Hannson | 312/132 |
| 5,007,148 | A | * | 4/1991 | Bida | 27/1 |
| 5,230,127 | A | | 7/1993 | Zukowski et al. | |
| 5,287,603 | A | | 2/1994 | Schorman | |
| 5,301,398 | A | * | 4/1994 | Bursey, Jr. | 27/7 |
| 5,349,727 | A | | 9/1994 | Niebergall | |
| 5,533,241 | A | * | 7/1996 | McConnell | 27/27 |
| 5,603,558 | A | * | 2/1997 | Zimmer | 206/566 X |
| 5,611,124 | A | | 3/1997 | Biondo et al. | |
| 5,625,933 | A | * | 5/1997 | Neuberger et al. | 27/1 |
| 5,675,876 | A | * | 10/1997 | Benedict et al. | 27/2 |
| 5,678,289 | A | | 10/1997 | Saaf | |
| 5,704,103 | A | * | 1/1998 | Crowley et al. | 27/1 |
| 5,709,441 | A | * | 1/1998 | Bartling et al. | 312/107 |
| 5,729,921 | A | * | 3/1998 | Rojas | 40/124.5 |
| 5,740,637 | A | * | 4/1998 | Snow | 27/1 X |
| 5,853,235 | A | * | 12/1998 | Barnes | 312/117 |
| 5,896,632 | A | * | 4/1999 | Sturino | 27/1 |
| 5,950,288 | A | * | 9/1999 | Bach Iahor | 27/1 |
| D423,249 | S | * | 4/2000 | Hawang | D6/440 |
| 6,050,660 | A | * | 4/2000 | Gurley | 312/249.1 |

FOREIGN PATENT DOCUMENTS

AU 199923869 10/1999

OTHER PUBLICATIONS

Batesville Services, Inc., *Personal Options*, ©1997.

* cited by examiner

*Primary Examiner*—William L. Miller
(74) *Attorney, Agent, or Firm*—Wood, Herron & Evans, L.L.P.

(57) ABSTRACT

A cremation remains container comprises a receptacle adapted to receive therein cremation remains, and a memorial plaque, adapted to be inscribed with an inscription of memorialization, movably mounted to the receptacle for movement to and between a display position exposing the plaque in view and a storage position concealing the plaque from view. The cover includes a transparent pane. A removable tray adapted to receive mementos of memorialization therein is included in the cremation remains container, is positioned adjacent the wall, is accessible via the cover and the mementos therein are visible through the pane. Optionally or alternatively the container may include a picture frame mounted to the cover whereby a picture placed in the frame is visible through the pane.

21 Claims, 2 Drawing Sheets

CREMATION REMAINS CONTAINER WITH MEMORIALIZATION FEATURES

FIELD OF THE INVENTION

This invention relates generally to the funeral industry, and more particularly to the cremation segment of the funeral industry. More specifically, the invention relates to cremation remains containers including memorialization features as a part thereof.

BACKGROUND OF THE INVENTION

Cremation is a growing segment of the funeral industry. Consequently, there is an increasing demand for more and higher quality styles and designs of cremation urns.

Likewise, memorialization is in ever greater demand in the funeral industry. As families have sought more meaningful ceremonies in celebration of the lives of their deceased loved ones, the assignee of the present invention has responded with new and innovative funeral products. To that end, the assignee of the present invention introduced to the industry both a cremation urn and a casket incorporating integral memorabilia compartments for the placement, display and storage therein of personal effects and mementos of memorialization of the deceased, as disclosed in its U.S. Pat. Nos. 4,324,026 and 5,611,124, respectively, both of which are hereby incorporated by reference herein as if fully set forth in their entirety.

There is a continuing demand for new and innovative styles and designs of funeral products, including cremation urns, which include memorialization features therein to assist in the cathartic process of the grieving family members of the deceased loved one.

SUMMARY OF THE INVENTION

In one aspect, the present invention is a cremation remains container comprising a receptacle adapted to receive therein cremation remains, and a memorial plaque, adapted to be inscribed with an inscription of memorialization, movably mounted to the receptacle for movement to and between a display position exposing the plaque in view and a storage position concealing the plaque from view.

The cremation remains container preferably comprises a base, at least one wall extending from the base, and a cover closeable upon the wall, with the plaque being movably mounted to the base. More preferably, the cremation remains container has two pairs of opposed walls, with the cover being pivoted to one of the walls. The plaque is preferably slidably mounted to the base. The base and plaque preferably define cooperating dovetail structure retaining the plaque in the base. Preferably, the plaque pulls out from the front of the base and the wall to which the cover is pivoted is a rear wall. Preferably the cover includes a transparent pane. A removable tray adapted to receive mementos of memorialization therein is preferably included in the cremation remains container, is positioned adjacent the wall, is accessible via the cover and the mementos therein are visible through the pane.

The cremation remains container may optionally or alternatively preferably include a picture frame mounted to said cover whereby a picture placed in the frame is visible through the pane.

In another aspect, the invention is a cremation remains container comprising a receptacle adapted to receive therein cremation remains, the receptacle including a closeable cover, the cover including a transparent pane, and a removable tray adapted to receive mementos of memorialization therein positioned in the receptacle, the tray accessible via the cover and the mementos therein visible through the pane.

In yet another aspect, the invention is a cremation remains container comprising a receptacle adapted to receive therein cremation remains, a cover closeable upon the receptacle, a tray adapted to receive mementos of memorialization therein positioned in the receptacle and accessible via the cover, and a memorial plaque, adapted to be inscribed with an inscription of memorialization, movably mounted to the receptacle for movement to and between a display position exposing the plaque in view and a storage position concealing the plaque from view.

The invention thus provides an attractive cremation remains container with several memorialization features built into the container.

These and other features and advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF THE INVENTION

Figure 1:
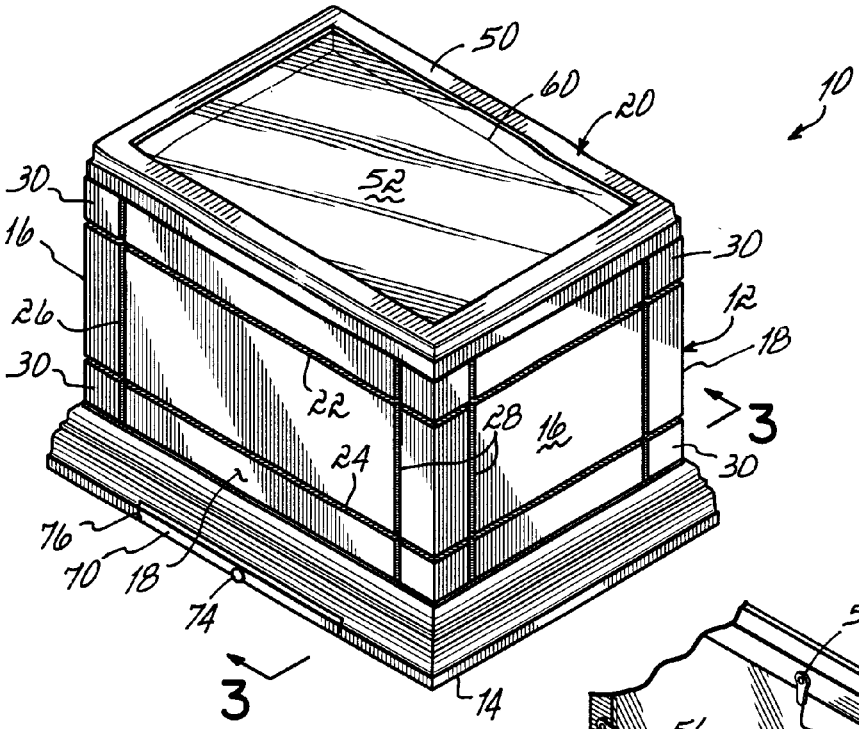
FIG. 1 is a perspective view of the cremation remains container of the present invention.

Referring first to FIG. 1, there is illustrated a cremation remains container 10 embodying the principles of the present invention. The container 10 comprises, generally, a receptacle 12 which may itself include a decorative base 14, for example base mold, two pairs of opposed walls 16, 16 and 18, 18 extending upwardly from the base 14, and a cover 20 closeable atop the walls 16, 16 and 18, 18.

The container 10 is preferably fabricated of a decorative furniture grade wood, for example cherry. A pair of decorative horizontal grooves 22, 24 and a pair of decorative vertical grooves 26, 28 may preferably be inscribed in and adorn each wall of the two pairs of opposed walls 16, 16 and 18, 18 to present an attractive, ornamental appearance. Decorative corner trim pieces 30, fabricated of for example brass, may further be installed, for example via adhesive, to the corners of the two pairs of opposed walls 16, 16 and 18, 18 to provide additional styling detail. The two pairs of opposed walls 16, 16 and 18, 18 may themselves be secured together via adhesive, screws or the like as well as with the same to the base 14.

Figure 2:
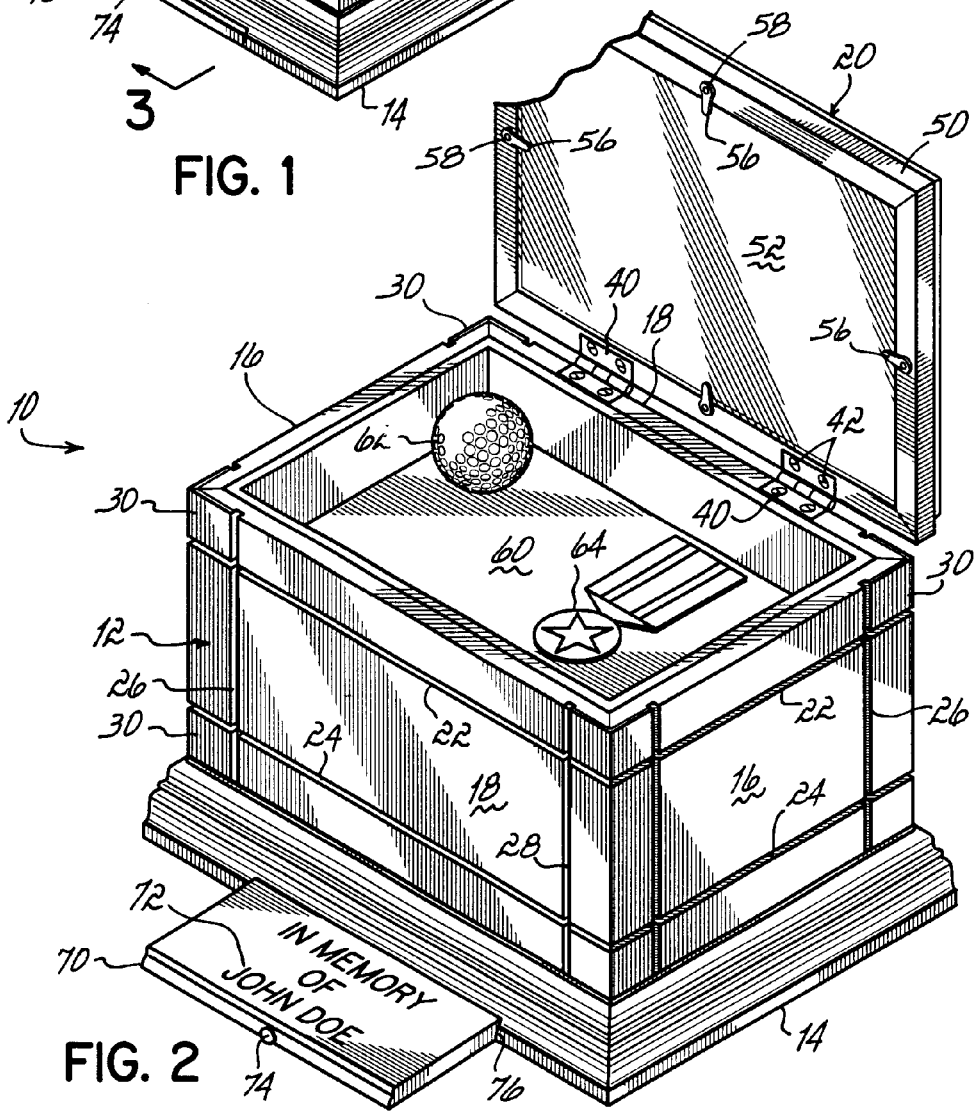
FIG. 2 is a view similar to FIG. 1, but enlarged, with the cover of the container in the open position revealing the memento tray and with the inscribed plaque in the exposed in view position.

Referring now to FIG. 2, there it will be seen that the cover 20 is pivoted to one wall 18 of one pair 18, 18 of the two pairs of opposed walls via hinges 40. Hinges 40 may preferably be brass, and are secured to the wall 18 and cover 20 via wood screws 42. Cover 20 includes a stylized wooden frame 50 within which is seated a transparent pane 52, for example glass pane. Glass pane 52 is secured into a countersink 54 in the frame 50 via pivotable retainers 56 themselves secured to the frame 50 via small screws 58. Transparent pane 52 thus provides visual access therethrough to the upper part of container 10 which advantageously may include a memorabilia tray 60 therein. Memorabilia tray 60 is preferably removable from the container 10, and is preferably lined with a decorative lining, for example velvet (not shown) and provides storage and display space for mementos of memorialization of the deceased, for example golf ball 62, armed forces medal 64 and the like.

A further memorialization feature of the invention is the inclusion of a memorialization plaque 70 slidably mounted in the base 14 of the container 10 which includes an inscription of memorialization 72 thereon for memorializing the deceased. Plaque 70, also known as a so-called "reader board", preferably includes a decorative, for example brass knob 74 secured to a front edge thereof for withdrawing the plaque from its concealed storage position within base 14 to its exposed display position out of base 14. Plaque 70 and base 14 preferably include cooperating dovetail structure 76 for retaining the plaque 70 within the base 14, in other words preventing the plaque 70 from dropping out the bottom of the container 10.

Figure 3:
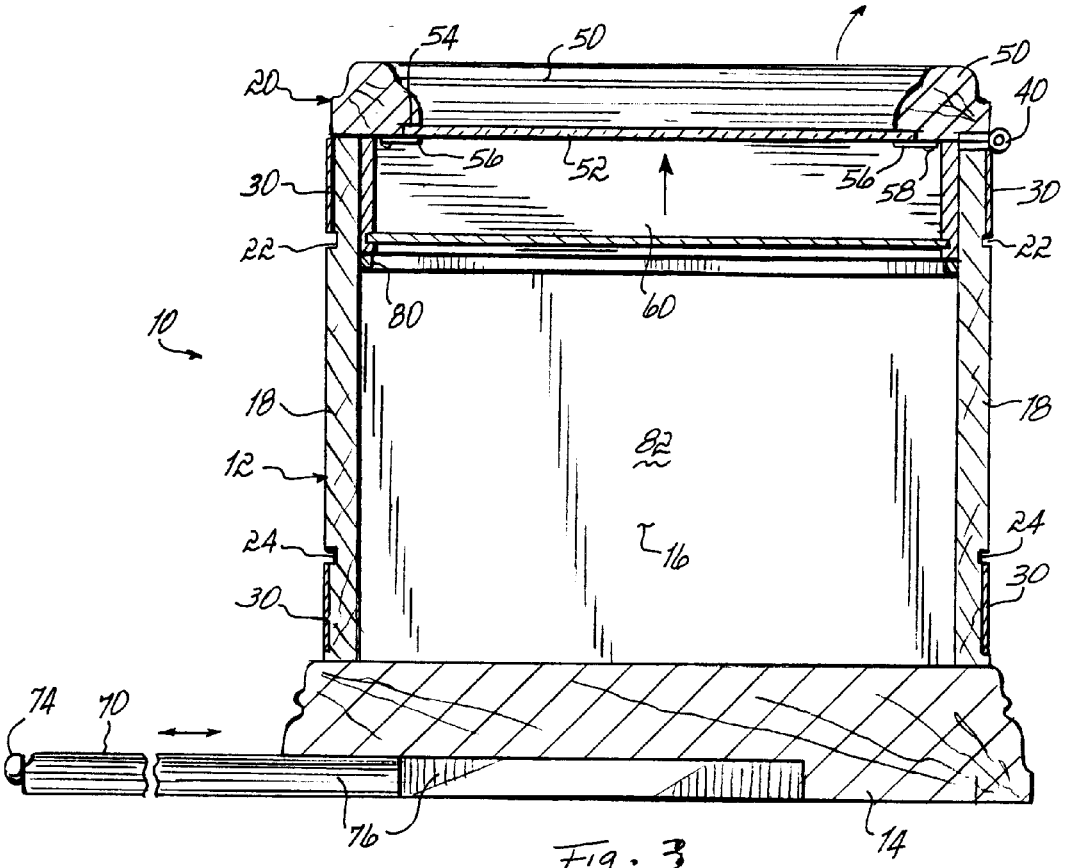
FIG. 3 is a view taken along line 3—3 of FIG. 1.

Referring now to FIG. 3, the container 10 preferably includes a circumferential rib 80 attached to each wall of the two pairs of opposed walls 16, 16 and 18, 18 via adhesive, screws or the like. Rib 80 provides a support atop which tray 60 is supported in the container 10. The volume below the tray 60, shown at 82, is for storing the cremation remains. Overall the container 10 has a rectangular footprint of about 11.75 inches by about 8.75 inches, and is about 8.3 inches tall.

Figure 4:
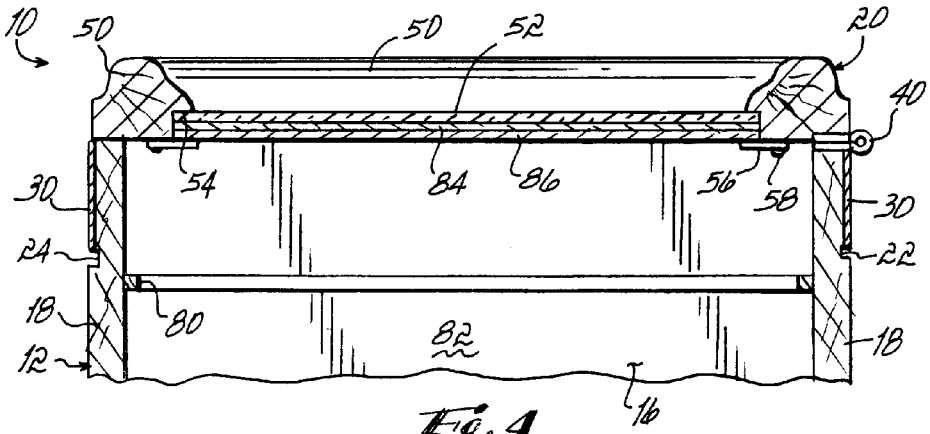
FIG. 4 is a view similar to FIG. 3 illustrating the picture frame formed in the cover.

FIG. 4 illustrates a variation of the container 10 shown in FIGS. 1–3. In FIG. 4, recess 54 in the frame 50 of cover 20 is somewhat deeper to accommodate, in addition to the transparent pane 52, picture frame mat 84 and picture backing board 86. In this embodiment, in the event that a loved one of the deceased wishes to install a picture between the picture frame mat 84 and picture backing board 86, for example picture of the deceased, the picture will of course be visible through pane 52 when the cover 20 is in the closed position, and the mementos of memorialization 62, 64 in tray 60 will not be visible.

Those skilled in the art will readily recognize numerous adaptations and modifications which can be made to the present invention which will result in an improved cremation remains container with means for memorialization, yet all of which will fall within the spirit and scope of the present invention as defined in the following claims. For example, while the cremation remains container has been shown and described as having its memorialization plaque movably mounted to the base of the container, the plaque could be mounted to the walls or cover of the container and still be within the scope of the invention. Also, while the container has been shown and described as being rectangular, the container could take most any geometry and likewise still fall within the scope of the invention. Further, while cherry and brass have been described as preferable materials from which to fabricate the container and hardware, other materials could of course be utilized and all are encompassed by the invention. Accordingly, the invention is to be limited only by the scope of the following claims and their equivalents.

What is claimed is:

1. A cremation remains container comprising:

a receptacle adapted to receive therein cremation remains;

a memorial plaque, adapted to be inscribed with an inscription of memorialization, movably mounted to said receptacle for movement to and between a display position exposing said plaque in view and a storage position concealing said plaque from view;

further comprising:

a base mold;

said receptacle having at least one wall extending from said base mold;

said receptacle having a cover closeable upon said at least one wall; and said plaque being movably mounted to said base mold.

2. The cremation remains container of claim 1 wherein said at least one wall comprises two pairs of opposed walls, and said cover is pivoted to one wall of said two pairs of opposed walls.

3. The cremation remains container of claim 2 wherein said plaque is slidably mounted to said base mold.

4. The cremation remains container of claim 3 wherein said base mold and plaque define cooperating dove tail structure retaining said plaque in said base mold.

5. The cremation remains container of claim 4 wherein said plaque pulls out from a front of said base mold and said one wall to which said cover is pivoted is a rear wall.

6. The cremation remains container of claim 1 wherein said cover includes a transparent pane.

7. The cremation remains container of claim 6 further including a removable tray adapted to receive mementos of memorialization therein positioned adjacent said at least one wall, said tray accessible via said cover and the mementos adapted to be visible through said pane.

8. A cremation remains container comprising:

a receptacle adapted to receive therein cremation remains; and a memorial plaque, adapted to be inscribed with an inscription of memorialization, movably mounted to said receptacle for movement to and between a display position exposing said plaque in view and a storage position concealing said plaque from view;

further comprising:

a base mold;

said receptacle having at least one wall extending from said base mold; and said receptacle having a cover closeable upon said at least one wall;

said plaque being movably mounted to said base mold;

wherein said cover includes a transparent pane;

said cover further including a picture frame whereby a picture placed therein is visible through said pane.

9. A cremation remains container comprising:

a chest-shaped receptacle adapted to receive therein cremation remains:

said receptacle including a closeable cover, said cover facing upwardly and including a transparent pane; and a removable tray adapted to receive mementos of memorialization therein positioned in said receptacle, said tray installable and removable only via said cover and the mementos adapted to be visible through said pane.

10. The cremation remains container of claim 9 wherein said receptacle includes two pairs of opposed walls, and said cover is pivoted to one wall of said two pairs of opposed walls.

11. The cremation remains container of claim 9, said cover further including a picture frame whereby a picture placed therein is visible through said pane.

12. A cremation remains container comprising:

a receptacle adapted to receive therein cremation remains;

said receptacle including a closeable cover, said cover including a transparent pane; and a removable tray adapted to receive mementos of memorialization therein positioned in said receptacle, said tray installable and removable only via said cover and the mementos adapted to be visible through said pane;

further comprising a memorial plaque, adapted to be inscribed with an inscription of memorialization, movably mounted to said receptacle for movement to and between a display position exposing said plaque in view and a storage position concealing said plaque from view.

13. The cremation remains container of claim 12 wherein said receptacle includes a base and wherein said plaque is slidably mounted to said base.

14. The cremation remains container of claim 13 wherein said base and plaque define cooperating dove tail structure retaining said plaque in said base.

15. The cremation remains container of claim 12 wherein said plaque pulls out from a front edge of said receptacle and said cover is pivoted to a rear edge of said receptacle.

16. A cremation remains container comprising:

a receptacle adapted to receive therein cremation remains, said receptacle having a base mold;

a cover closeable upon said receptacle;

a tray adapted to receive mementos of memorialization therein positioned in said receptacle and accessible via said cover; and a memorial plaque, adapted to be inscribed with an inscription of memorialization, movable mounted to said base mold of said receptacle for movement to and between a display position exposing said plaque in view and a storage position concealing said plaque from view.

17. The cremation remains container of claim 16 wherein said receptacle comprises two pairs of opposed walls, and said cover is pivoted to one wall of said pair of opposed walls.

18. The cremation remains container of claim 17 wherein said plaque is slidably mounted in said base mold.

19. The cremation remains container of claim 18 wherein said base mold and plaque define cooperating dove tail structure retaining said plaque in said base mold.

20. The cremation remains container of claim 18 wherein said plaque pulls out from a front of said base mold and said one wall to which said cover is pivoted is a rear wall.

21. A cremation remains container comprising:

a receptacle adapted to receive therein cremation remains;

a cover closeable upon said receptacle;

a tray adapted to receive mementos of memorialization therein positioned in said receptacle and installable and removable only via said cover; and a memorial plaque, adapted to be inscribed with an inscription of memorialization, movably mounted to said receptacle for movement to and between a display position exposing said plaque in view and a storage position concealing said plaque from view.

* * * * *